US007310894B1

(12) United States Patent
Schwarzman et al.

(10) Patent No.: US 7,310,894 B1
(45) Date of Patent: Dec. 25, 2007

(54) FOOTWEAR FOR USE IN SHOWER

(76) Inventors: John L. Schwarzman, 2046 Swan Neck Way, Reston, VA (US) 20191; Shirley Elliott, 900 Country Club Dr., Vienna, VA (US) 22180

( * ) Notice: Subject to any disclaimer, the term of this patent is extended or adjusted under 35 U.S.C. 154(b) by 53 days.

(21) Appl. No.: 11/128,132

(22) Filed: May 12, 2005

(51) Int. Cl.
*A43B 5/08* (2006.01)
*A43B 7/06* (2006.01)
*A43C 15/02* (2006.01)

(52) U.S. Cl. ..... 36/8.001; 36/3 A; 36/3 R; 36/3 B; 36/59 R

(58) Field of Classification Search ..... 36/3 A, 36/3 R, 3 B, 59 R, 9 R
See application file for complete search history.

(56) References Cited

U.S. PATENT DOCUMENTS

| | | | | | |
|---|---|---|---|---|---|
| 1,550,772 | A * | 8/1925 | Russell | 36/59 R |
| 2,162,912 | A * | 6/1939 | Craver | 36/59 R |
| 2,185,762 | A * | 1/1940 | Cox | 36/8.1 |
| 2,251,468 | A * | 8/1941 | Smith | 36/32 R |
| 2,550,484 | A * | 4/1951 | Kaut, Jr. et al. | 36/90 |
| 3,605,292 | A * | 9/1971 | Goldblatt | 36/8.1 |
| 3,824,716 | A * | 7/1974 | Di Paolo | 36/32 R |
| 4,322,894 | A | 4/1982 | Dykes | 36/114 |
| 4,356,643 | A | 11/1982 | Kester et al. | 36/59 C |
| 4,419,836 | A | 12/1983 | Wong | 36/11.5 |
| 4,777,738 | A * | 10/1988 | Giese et al. | 36/32 R |
| 4,910,887 | A * | 3/1990 | Turner et al. | 36/114 |
| 5,467,537 | A * | 11/1995 | Aveni et al. | 36/50.1 |
| 5,901,472 | A * | 5/1999 | Adam | 36/134 |
| 6,076,283 | A | 6/2000 | Boie | 36/59 C |
| 6,990,755 | B2 * | 1/2006 | Hatfield et al. | 36/97 |
| 2004/0134100 | A1 * | 7/2004 | McVicker | 36/50.1 |
| 2006/0059717 | A1 * | 3/2006 | Mitchell | 36/59 R |

* cited by examiner

*Primary Examiner*—Ted Kavanaugh
(74) *Attorney, Agent, or Firm*—Michael P. Fortkort; Michael P. Fortkort PC

(57) ABSTRACT

A shower shoe diminishes the risk of slipping in wet and slippery areas. The shower shoe or slipper can be easily worn by an individual when taking a shower, bath or simply walking through a slippery area. The shower shoe includes a mesh top through which water can pass, a rubber sole with water drainage slits through which water can pass, and grooves on the bottom of the rubber sole that prevent hydroplaning when walking in water. A Velcro® closure enables simple fastening of the shoe. A loop on the back of the shoe enables one to easily grip the shoe when putting the shoe on or taking the shoe off. The same loop can be used to hang the shower shoe while drying it. Siping is included in the bottom side of the sole.

12 Claims, 8 Drawing Sheets

46

FOOTWEAR FOR USE IN SHOWER

FIELD OF THE INVENTION

The present invention relates generally to methods and apparatuses for protecting oneself from slipping, and more particularly to a method and apparatus for protecting oneself from slipping in a shower, bath, pool or the like.

BACKGROUND

Elderly people can suffer severe and debilitating injuries from falls, particularly in an environment, such as the home where many elderly live without constant supervision. Many injuries occur in the bathroom where standing water and tile combine to create a very slippery surface. Moreover, showers and baths provide other significant potential sites of falls for the same reasons.

While the above problems are exacerbated by age, these problems are not unique to the elderly, even though they may occur with more frequency among the elderly. Young children and adults of all ages can face similar injuries due to falls while in the bathroom, shower, bath, pool or the like.

There exist shoes to prevent slipping. For example, U.S. Pat. No. 6,076,283 discloses shoes and shoe outsoles for wet surfaces. However, this shoe cannot be worn in the shower or bath. U.S. Pat. No. 5,456,643 also discloses non-slip footwear, but cannot be worn in the bath or shower.

Sandals exist for use in wet areas, such as U.S. Pat. No. 4,419,836, which discloses footwear in the form of a sandal. But sandals can be easily dislodged from one's foot.

Surfing footwear exists, such as U.S. Pat. No. 4,322,894. But this footwear is not practical for walking and moving around in a shower, for example.

The present invention is therefore directed to the problem of developing a method and apparatus for reducing the risk of falling in a shower, bath, pool or the like.

SUMMARY OF THE INVENTION

The present invention solves these and other problems by providing a shower shoe or slipper than can be easily worn by an individual when taking a shower or bath or simply walking through a slippery area.

According to one aspect of the present invention, the shower shoe includes a mesh top through which water can pass, a rubber sole with water drainage slits through which water can pass, and grooves on the bottom of the rubber sole that prevent hydroplaning when standing (or walking) in water.

According to another aspect of the present invention, the shower shoe includes a Velcro® closure that enables simple, secure fastening of the shoe.

According to another aspect of the present invention, the shower shoe includes a loop on the back of the shoe that enables one to easily grip the shoe when putting the shoe on or taking the shoe off. The same loop can be used to hang the shower shoe while drying.

Other aspects of the invention will be apparent to those of skill in the art upon review of the detailed description in light of the following drawings.

DETAILED DESCRIPTION

It is worthy to note that any reference herein to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

The present invention inter alia enables one to take a shower in safety with diminished fear of slipping and falling. The footwear of the present invention is designed to be worn in the shower or bathtub or other similar area. The shower shoe of the present invention is designed to provide more secure footing on wet, slick surfaces, and to help prevent the wearer from slipping while bathing.

The shower shoe is designed to be easy to slip on and remove from the foot. The shower shoe is fastened at the front with an easy-to-grasp Velcro® closure. On the back of the shower shoe or slipper is a large loop to make the slipper easy to pull over the heel and to also make it easy to hang the slippers up to dry. The sole of the shower shoe or slipper is made of soft rubber. In the sole of the shower shoe are holes (and/or slits) that will allow water to drain through the shower shoe. The top of the shower shoe is made of nylon mesh material, for example.

Additionally, the shower shoe or slipper of the present invention provides additional "surface area" for traction on the on a slippery surface. The entire sole of the shoe comes in contact with the slippery surface, not just the narrow bottoms of the feet, which, heretofore was the only option available.

Figure 1:
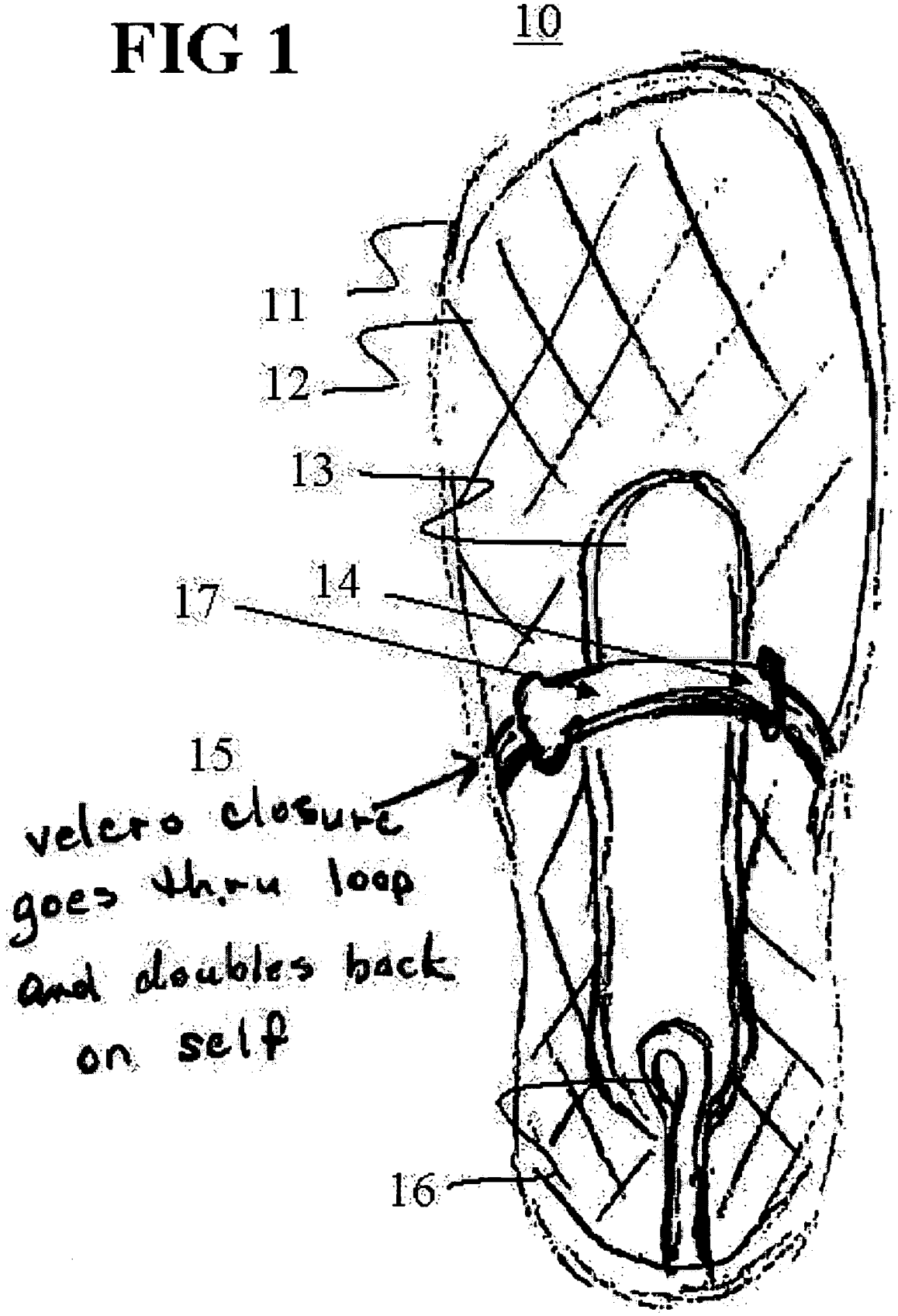
FIG. 1 depicts a top view of an exemplary embodiment of the shower shoe according to one aspect of the present invention.

An exemplary embodiment 10 of the shower shoe or slipper of the present invention is shown in FIG. 1. The shower shoe 10 includes a rubber sole 11 (see FIG. 4 for details of bottom design), a mesh top 12, a hole 13 in which the wearer places his or her foot, a fastening loop 14, a strap 17 with a Velcro® fastener 15, and a loop 16.

The mesh top 12 is made of a nylon or similar material that repels water and is light and easily fashioned into a mesh design. The mesh top 12 enables the water to pass through the top of the shoe to the inside of the shoe. Any suitable material that can repel water should suffice. Moreover, the design of the top is not limited to mesh, but can be any design that enables the water to pass through unimpeded.

The hole 13 is designed to be one-size fits all (or at least most sizes). The hole 13 can be modified for children sizes or extra large sizes. In one possible embodiment of the hole, an elastic band is sewn into the fabric to create a snug fit against the ankle or leg of the wearer.

The fastening loop 14 enables a strap 17 with a Velcro® fastener 15 to pass through and double back on itself to mate with the opposite Velcro® fabric on the fastener 15. The strap 17 includes a wide tab at the end to enable easier gripping and to prevent unlooping of the strap 17.

Loop 16 is employed to enable the wearer to easily slip the shower shoe on his or her foot. Loop 16 can also be used to hang the shower shoe when wet to dry it or when storing the shower shoe.

Figure 2:
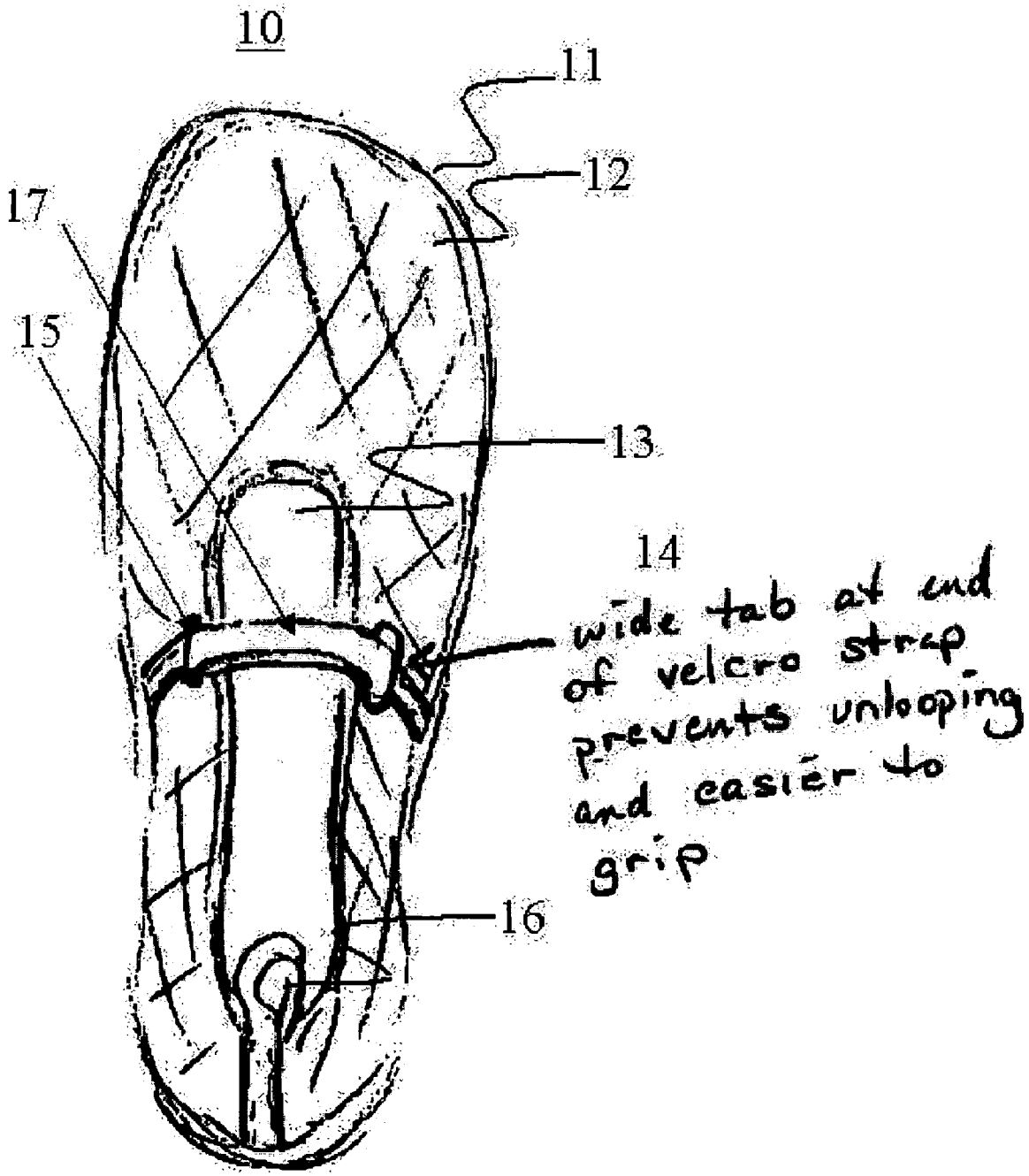
FIG. 2 depicts another top view of the exemplary embodiment of the shower shoe according to another aspect of the present invention.

FIG. 2 shows a top view of the embodiment of FIG. 1 with the fastening loop 14 shown more clearly.

Figure 3:
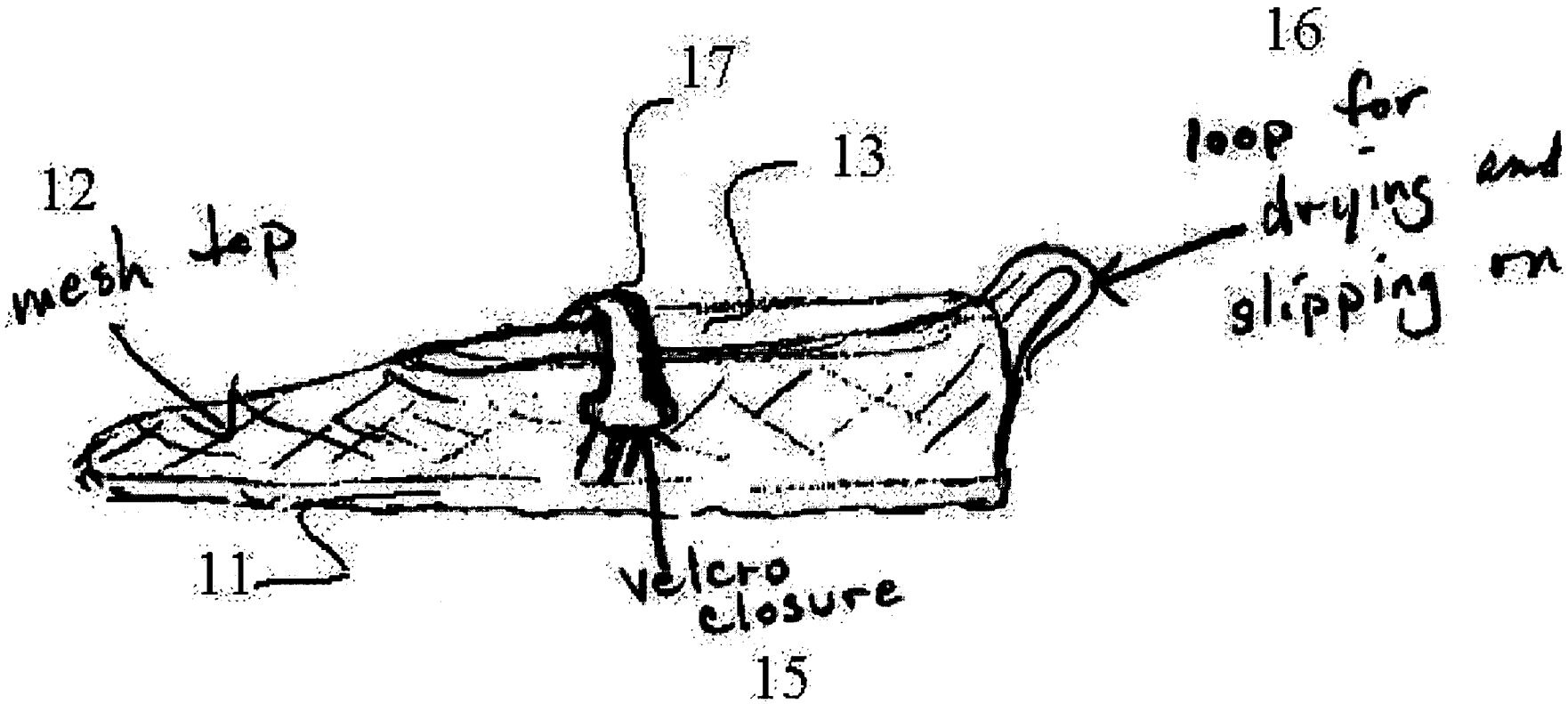
FIG. 3 depicts a side view of the exemplary embodiment of the shower shoe according to still another aspect of the present invention.

Turning to FIG. 3, shown therein is a side view of the shower shoe 10. The loop 16 can be seen more clearly here to enable one to hang the shower shoe 10 or to grasp the loop 16 when putting the shower shoe 10 on or taking the shower shoe 10 off. A plastic hook (not shown) can be added to a towel bar or to a suction cup (to attach inside the shower or wall above the bathtub) from which the loop 16 can be hung.

Figure 4:
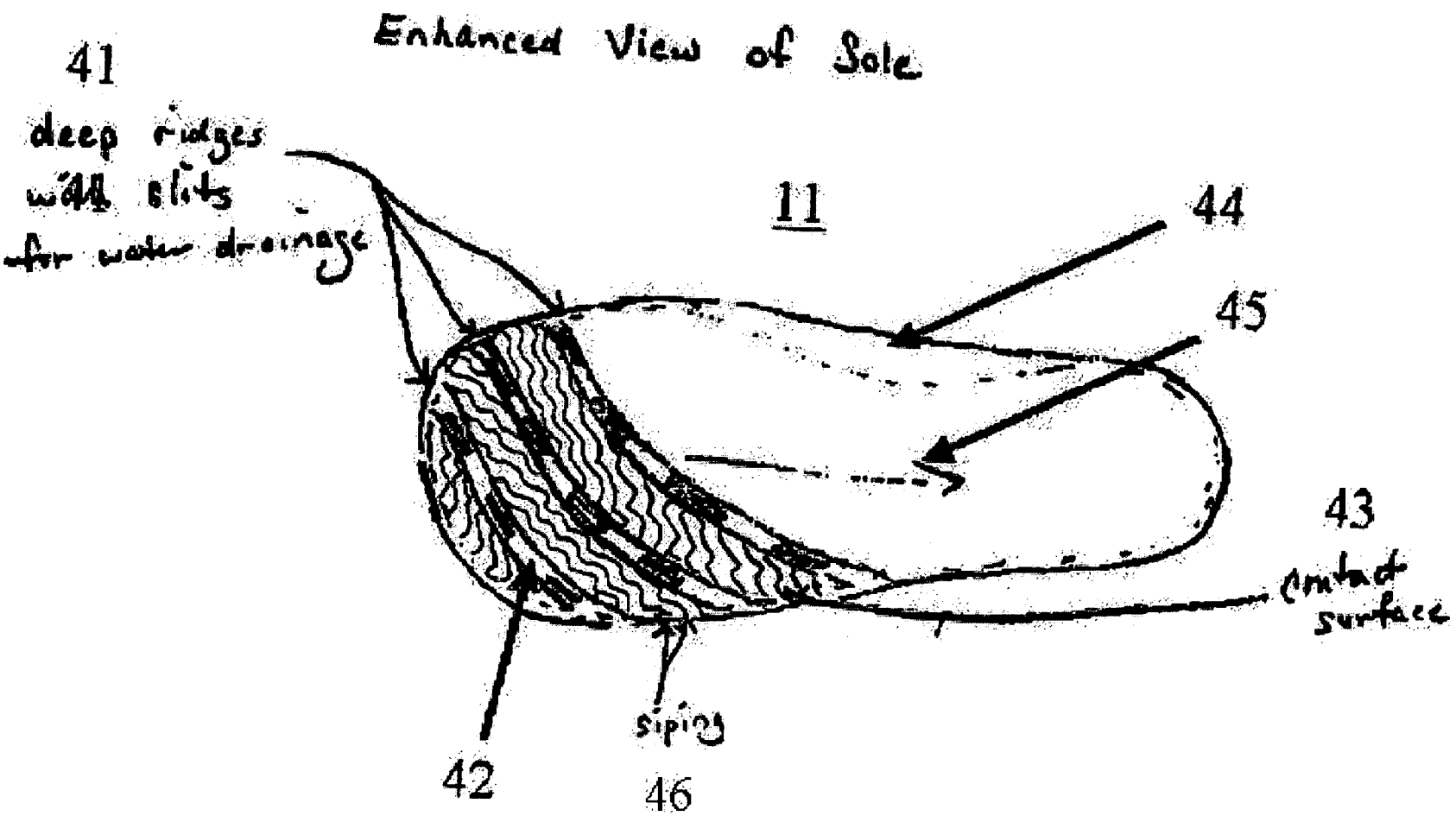
FIG. 4 depicts a bottom view of an exemplary embodiment of the sole of the shower shoe according to yet another aspect of the present invention.

Turning to FIG. 4, shown therein is a top view of the sole 11 used in the exemplary embodiment 10. The sole 11 is made of a rubber or other non-slip or sticky material. The sole 11 includes one or more water drainage slits 41 that extend through the sole through which water passes when the water enters the shower shoe 10. The size and shape of these slits 41 can vary widely depending on the ornamental aspects of one's design. The wider the slits 41 the more quickly the water will empty from the shower shoe. On the bottom of the sole 11 are grooves 42, which are similar to tire grooves. These grooves 42 serve to prevent hydroplaning when standing (or walking) in water. When weight is placed on the shoe, water exits from underneath the shower shoe 10 via these grooves, i.e., the grooves provide a place for water drainage. The size and shape of these grooves 42 can also vary widely depending on the desired ornamental design. The grooves 42 may incorporate the slits 41 as shown in FIG. 4, or the grooves 42 may be separate from the slits 41. As shown in FIG. 4, arrow 45 indicates that the grooves 42 and slits 41 (and siping) repeat in the pattern shown for the length of the bottom of the sole 11. Contact surface 43 provide the engagement between the sole 11 and the floor. The contact surface area 43 (as well as extended area 44) includes "siping" 46, which is a pattern of wave-like, e.g., sinusoidal or zig-zag, incisions in the bottom surface of the outsole (or sole, as used herein), which helps improve traction on wet surfaces. Area 44 is an extended portion of the sole 11 beyond that of the normal foot to provide increased contact surface with the floor, thereby increasing the adhesion (and reducing the possibility of slipping) between the sole 11 and the floor. Generally, the grooves 42 are much deeper and wider than the siping 46 to accommodate sufficient water flow to prevent hydroplaning.

Figure 5:
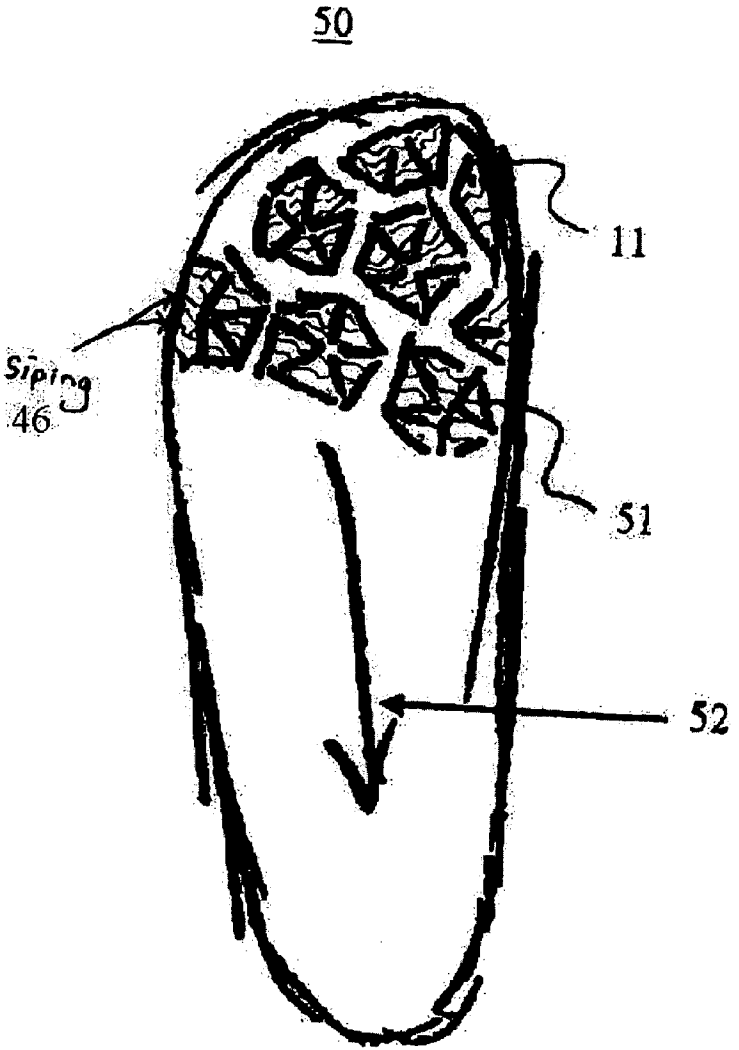
FIG. 5 depicts a bottom view of another exemplary embodiment of the sole of the shower shoe according to still another aspect of the present invention.

Turning to FIG. 5, shown therein is another possible embodiment 50 of the sole 11. Element 51 includes a hole and grooves, which are shown in more detail in FIG. 6. Arrow 52 indicates that the pattern repeats for the entire sole 11. Siping 46 is included in element 51, which siping 46 is separate and distinct from grooves 42.

Figure 6:
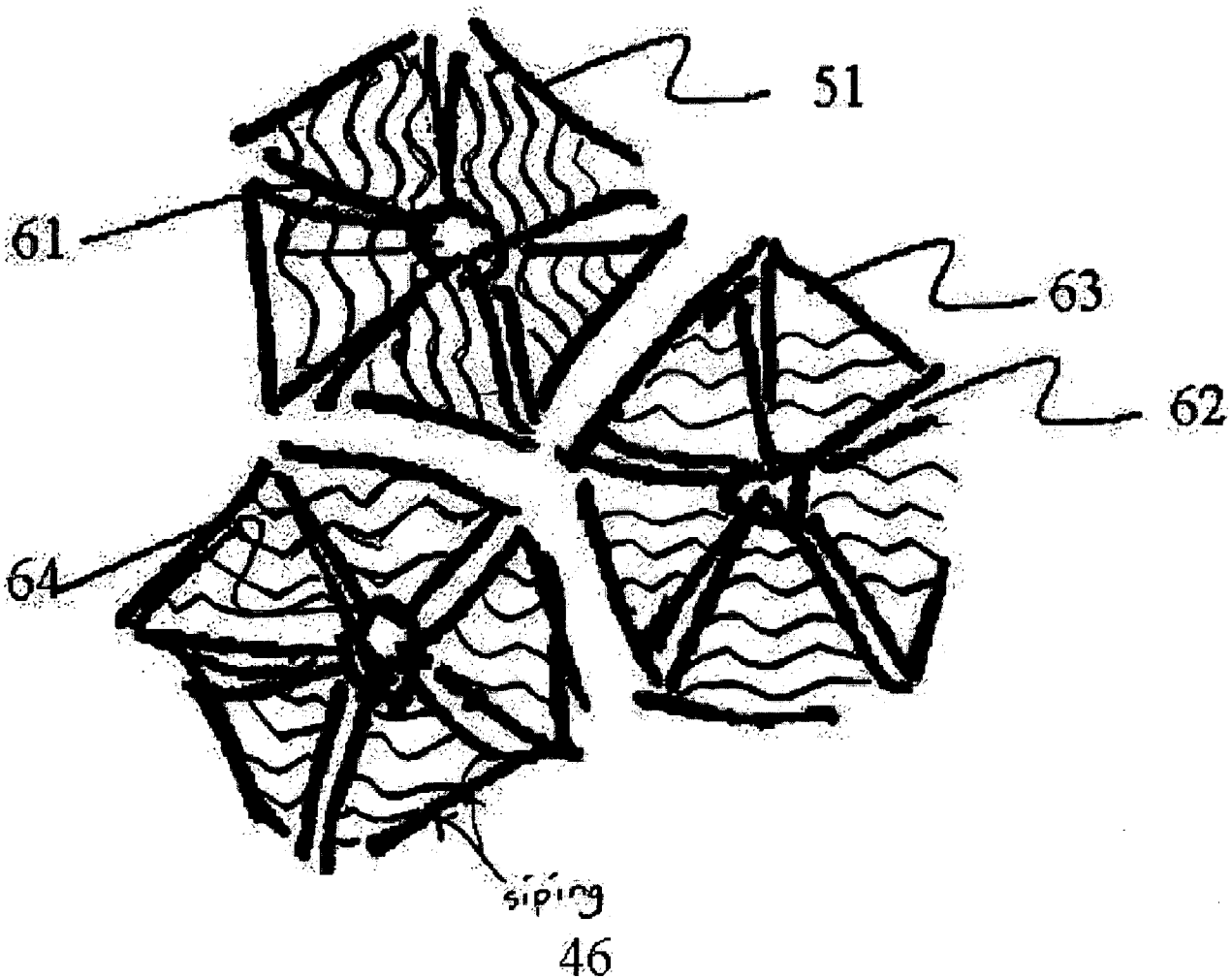
FIG. 6 depicts an enlarged view of one element of the exemplary embodiment of the sole of the shower shoe in FIG. 5 according to yet another aspect of the present invention.

Turning to FIG. 6, shown therein is an enlargement of element 51. Element 51 includes a hole 61 that extends through the sole, multiple protrusions 63 and grooves 62 that run between the multiple protrusions 63. In this embodiment, the overall element 51 is a pentagon, with a hole 61 in the center and triangular-shaped wedges 63 that piece together to comprise the pentagon with the grooves 62 between the wedges 63. Each of the triangular-shaped wedges 63 has an arc 64 on one side that mates with the arcs of the other wedges 63 to combine to form the hole 61. Siping 46 is included in each of the triangular-shaped wedges 63. Generally, the element 51 can be any geometric shape and is not limited to a pentagon, which forms only one possible embodiment. Even a random shape or patternless shape will suffice as long as the sole 11 includes one or more holes and/or one or more grooves, and perhaps siping.

Figure 7:
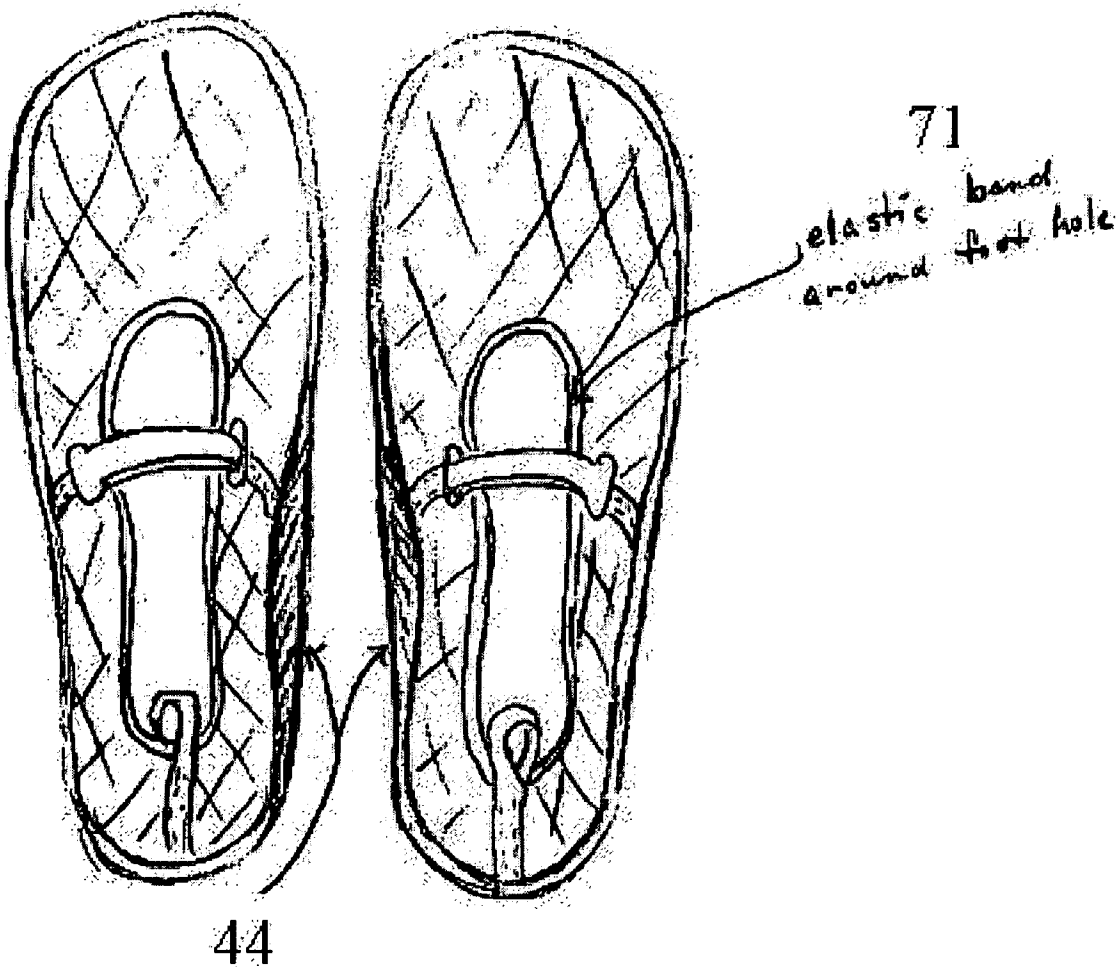
FIG. 7 depicts a top view of still another exemplary embodiment of the shower slipper according to yet another aspect of the present invention.

Turning to FIG. 7, shown therein is another exemplary embodiment of the shower shoe or slipper of the present invention. This embodiment includes an elastic band 71 that provides a snug fit against the ankle or leg of the wearer of the shoe. This embodiment includes the increased surface area 44 that extends beyond the normal footprint of one's foot to provide increased contact surface area with the floor. The size of this extension can be made as desired, but the larger the area the more increased contact and the reduced possibility of slippage.

Figure 8:
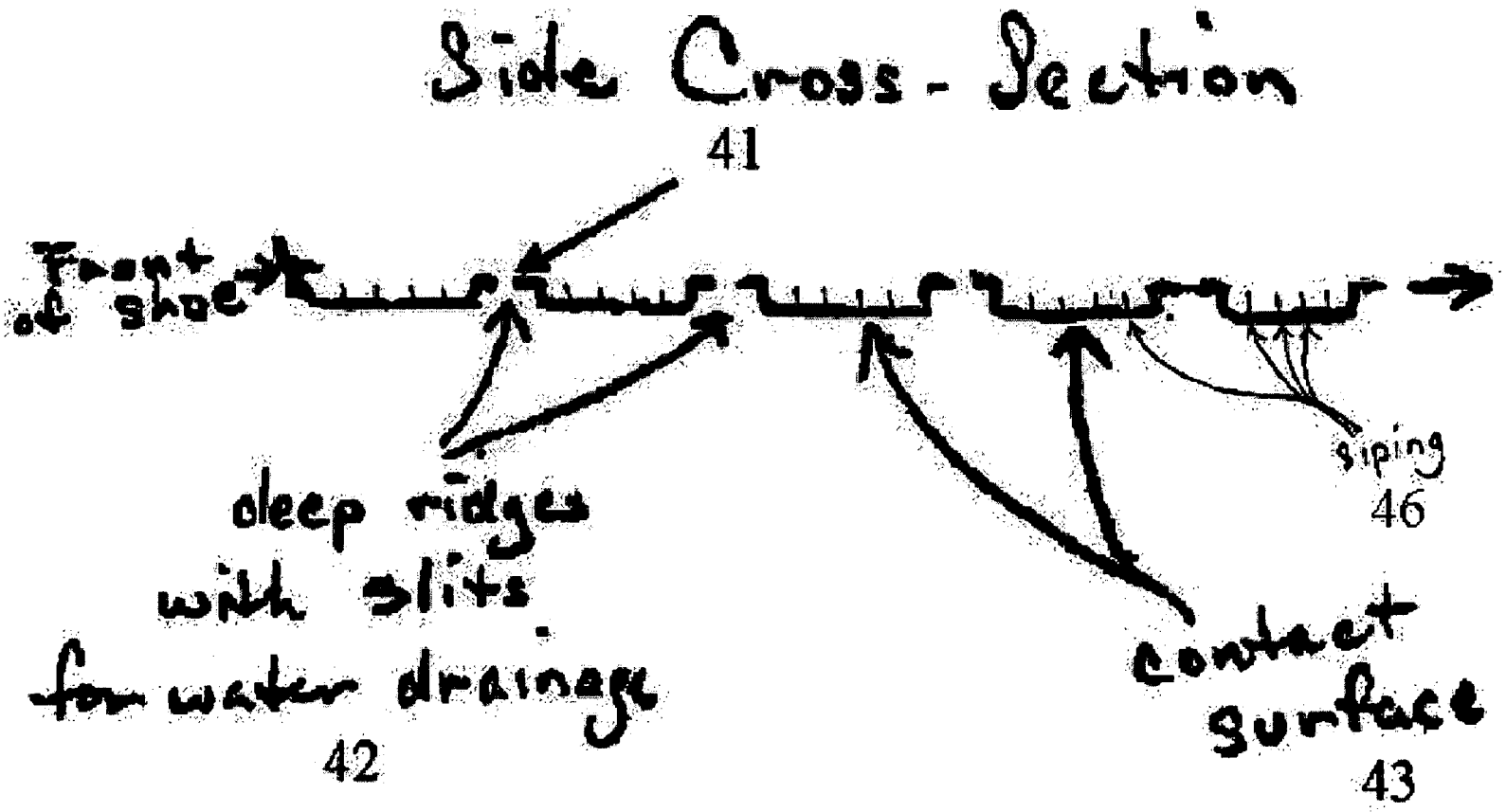
FIG. 8 depicts a side view of one exemplary embodiment of the grooves according to one aspect of the present invention.

Turning to FIG. 8, shown therein is a side view of the sole 11 depicting the pattern of the contact surfaces 43, grooves 42, slits 41 and siping 46. This pattern looks like a square wave with spaces in the top where the slits 41 are disposed. The peaks of the square wave represent the sides of the grooves 42 and the bottoms of the square wave represent the contact surfaces 43. This figure makes clear the difference between the grooves 42 and siping 46 in terms of the wideness and depth of the grooves 42 vis-à-vis the siping 46.

Although various embodiments are specifically illustrated and described herein, it will be appreciated that modifications and variations of the invention are covered by the above teachings and are within the purview of the appended claims without departing from the spirit and intended scope of the invention. For example, certain materials are disclosed for use in the top and sole, but other similar materials will suffice. Furthermore, these examples should not be interpreted to limit the modifications and variations of the invention covered by the claims but are merely illustrative of possible variations.

What is claimed is:

1. An apparatus for wearing on a foot comprising:

a rubber sole having a top side and a bottom side;

one or more grooves disposed on the bottom side of the sole;

a shoe upper having a plurality of holes;

one or more holes disposed in the rubber sole through which water may pass;

siping disposed on the bottom side of the sole; and a repeating geometric shaped figure on the bottom side of the sole, in which the repeating geometric shaped figure includes a plurality of segments, each of which combines with all of the other segments to form one of the holes in the sole, and between each segment lies one of the grooves in the bottom side of the sole.

2. The footwear according to claim 1, further comprising:

a mesh top through which water can pass.

3. The footwear according to claim 1, further comprising:

a fastening strap including a hook and loop fastener closure; and a fastening loop through which the fastening strap can pass and double back on itself for fastening.

4. The footwear according to claim 3, wherein:

the fastening strap includes a wide tab at one end to prevent the fastening strap from passing back through the loop when wearing the footwear.

5. The footwear according to claim 1, further comprising:

a grasping loop disposed on a back of the footwear.

6. The apparatus according to claim 1, further comprising:

a fastening strap including a hook and loop fastener closure;

a fastening loop through which the fastening strap can pass and double back on itself for fastening;

the fastening strap includes a wide tab at one end to prevent the fastening strap from passing back through the fastening loop when wearing the footwear; and a grasping loop disposed on a back of the footwear.

7. The apparatus according to claim 1:

wherein said siping is disposed in each of the geometric shaped figures.

8. The apparatus according to claim 1, further comprising:

said shoe upper including an elastic band around a hole to accept a foot and said hole is suitable for accepting most foot sizes.

9. The apparatus according to claim 1, further comprising:

a fastening strap including a hook and loop fastener closure.

10. The apparatus according to claim 9, further comprising:

a fastening loop through which the fastening strap can pass and double back on itself for fastening.

11. The apparatus according to claim 10, wherein:

the fastening strap includes a wide tab at one end to prevent the fastening strap from passing back through the fastening loop when wearing the footwear.

12. The footwear according to claim 1, further comprising:

a grasping loop disposed on a back or the footwear.

* * * * *